United States Patent [19]

Akiyama

[11] 3,982,459

[45] Sept. 28, 1976

[54] TOY MUSICAL VEHICLE

[75] Inventor: Kenzo Akiyama, Long Beach, Calif.

[73] Assignee: Tomy Kogyo Co., Inc., Tokyo, Japan

[22] Filed: Feb. 13, 1975

[21] Appl. No.: 549,526

[30] Foreign Application Priority Data

Feb. 25, 1974 Japan ..... 49-22108

[52] U.S. Cl. ..... 84/83; 46/179; 46/202

[51] Int. Cl.[2] ..... G10F 1/12; G10F 5/06

[58] Field of Search ..... 46/179, 204, 202; 84/83, 86–91, 97–100

[56] References Cited

UNITED STATES PATENTS

| | | | |
|---|---|---|---|
| 287,599 | 10/1883 | Welte | 84/91 |
| 559,183 | 4/1896 | Main | 84/98 |
| 566,150 | 8/1896 | Ehrlich | 84/87 |
| 884,094 | 4/1908 | De Kleist | 84/91 |
| 964,607 | 7/1910 | Brauer | 84/89 |
| 2,143,513 | 1/1939 | Giaimo | 46/179 X |
| 2,487,413 | 11/1949 | Barnum | 84/97 |
| 2,916,959 | 12/1959 | Bangs et al. | 84/97 |
| 3,710,668 | 1/1973 | Van Sice et al. | 84/98 |
| 3,747,459 | 7/1973 | Schmidt et al. | 84/94 |
| 3,850,070 | 11/1974 | Laurent | 84/95 |
| 3,863,539 | 2/1975 | Gay et al. | 84/94 |
| 3,908,505 | 9/1975 | Ono | 84/83 |

*Primary Examiner*—Lawrence R. Franklin
*Attorney, Agent, or Firm*—Edward D. O'Brian

[57] ABSTRACT

A toy musical vehicle can be constructed within a simulated vehicle body so as to utilize a single motor to simultaneously drive and operate a music producing mechanism and the vehicle. The vehicle is driven by coupling the motor to wheels of the vehicle through the use of a conventional gearing arrangement. The music producing mechanism preferably includes a fan which supplies air under pressure to a wind chest coupled to the motor. This wind chest is utilized in conjunction with valve actuators and valves which control the release of air so as to create sound in a conventional manner. The valve actuators are normally biased outwardly from the wind chest by the pressure of the air within the wind chest so that followers on these actuators are in a position to be engaged by any of a plurality of cams formed so as to extend from the surface of a rotary record member. The periphery of such a record member is formed as a ring gear and mates with a spur gear driven by the motor through a drive train. This record member is supported in a vertical slot in such a manner that it can be dropped in place so as to be rotated by the spur gear in order to bring the cams into contact with the followers so as to move the actuators and associated valve members to selectively control the flow of air from the wind chest. The music producing mechanism is capable of and is considered desirable for independent utilization apart from such a vehicle.

9 Claims, 5 Drawing Figures

10
12
14
16
18
20
22
34
36
40
46
48
58
2
3

12
16
26
28
32
36
38
42
44
50
52
54
56
58

26
70
72
74
30
12

TOY MUSICAL VEHICLE

BACKGROUND OF THE INVENTION

The invention set forth in this specification is broadly directed towards new and improved musical instruments. In its more specific aspects this invention is concerned with toy vehicles incorporating such instruments as integral parts of such vehicles.

An understanding of the present invention does not require an extensive discussion of either prior musical instruments and/or prior toy vehicles. As civilization has progressed increasingly previously known music and/or sound producing mechanisms have been incorporated into or used in conjunction with various types of toy vehicles such as simulated railroad engines, cars, trucks and the like. Such combined structures have been mutually complementary in that the music and/or sound producing mechanisms incorporated into or used by such vehicles have made such vehicles more desirable than previously for play purposes and vice versa.

In the past such combined structures have frequently utilized percussion type devices to produce music and/or sound. They have also frequently utilized so-called "music box" mechanisms consisting of a rotatable drum or similar structure carrying projections which sequentially pluck various different teeth or reeds as the drum is rotated. While such structures have been effective for play purposes such effectiveness has tended to be limited because of tonal and/or sound considerations or because of difficulties relating to playing different musical compositions with them.

This problem of playing different musical compositions is not unique to the field of "pure" toys. Traditionally it has been relatively difficult to replace the actuating drums used to "play" different compositions within a music box and/or a related structure such as a drum organ. Further, even if such replacement has been provided for in such an instrument the storage of such drums without damage has often presented an undesirable complication or problem. A recognition of these factors has lead to the development of various different structures replacing an actuating drum with any of a plurality of different types of mechanisms.

Comparatively early in the development of music boxes such drums were replaced by flat metal disks having pins and/or projections extending from their surfaces. Normally such disks were formed so as to include a gear type mechanism for rotating them in order to actuate the teeth or reeds of a music box comb or valves of an organ structure. Disks have also been constructed so as to be perforated in such a manner as to selectively pass an air stream to any of a plurality of sound producing elements during disk rotation in order to enable an instrument to play a musical composition. While such structures are utilitarian they are considered relatively undesirable because they ave not effectively utilized both surfaces of a disk type record member in the manner in which both surfaces of a common phonograph record are used.

Perhaps it is more important that such disks have been relatively difficult to mount in an operative manner in a musical instrument so as to achieve a desired mode of consistent operation. In the toy field this latter is quite important since generally speaking children are incapable of effectivelyl utilizing even moderately complex mounting structures which hve been necessary to hold prior actuating disks in an operative manner.

SUMMARY OF THE INVENTION

A broad objective of the present invention is to provide new and improved musical instruments, and especially new and improved musical instruments of a type capable of being easily and conveniently operated by children lacking any significant degree of mechanical sophistication. The invention is also intended to supply musical instruments as noted which may be easily and conveniently constructed at a comparatively nominal cost, which may be easily and conveniently utilized for their intended purpose, which are quite reliable in their performance characteristics, and which may be easily incorporated into toy vehicles as integral parts of such vehicles.

The latter has a significance which is not readily apparent. In the toy field economy of manufacture is of critical importance. The toy musical instruments of the present invention are intended to be utilized in combination with toy vehicles so that only a single power source such as a motor will concurrently propel such a vehicle and automatically operate the music producing mechanism. Further such a vehicle is preferably constructed so that various different "record" members to obtain different musical compositions can be carried by such a vehicle and inserted by a child with respect to the music producing mechanism with virtually no difficulty.

These objectives relative to a musical instrument are achieved by providing in the combination of a compressed gas source, a wind chest connected to such a source, a plurality of sound producing means for use in producing sound in response to a stream of compressed gas located adjacent to the wind chest, valve means for controlling the flow of such gas from the wind chest to such sound producing means and a rotary disk for controlling the operation of such valve means the improvement which comprises: this disk being located in a slot extending less than 180° around the periphery of the disk and fitting with respect to the disk in such a manner that the disk is held so that as it is rotated it cannot move in an axial direction and so that as it is rotated it will selectively actuate various of these valve means, and drive means located so as to extend into the slot for engaging the periphery of the disk in order to rotate the disk during the operation of the instrument, this disk being held within the slot by gravity so that there is engagement between the periphery of the actuator and the drive means.

In a structure of this type the disk may be referred to as an actuator, an actuating member, an actuating disk or a record member. Preferably its periphery is provided with a ring gear which mates with a spur gear serving as the drive means. Further, preferably such a disk is formed so that both of its surfaces contain different cams or projections for causing the instrument to play different musical compositions. This type of structure is considered to be most effectively utilized to achieve simplicity coupled with reliability in a toy vehicle in which a single motor or similar power source is used to concurrently drive the vehicle, rotate the disk, and to supply a stream of compressed gas to the wind chest. Preferably this gas is used in the wind chest for controlling followers or actuators such that they are biased against the surface of the actuating member when the instrument is operating.

BRIEF DESCRIPTION OF THE DRAWING

Because of the nature of this invention it is best more fully explained with reference to the accompanying drawings in which.

Figure 1:
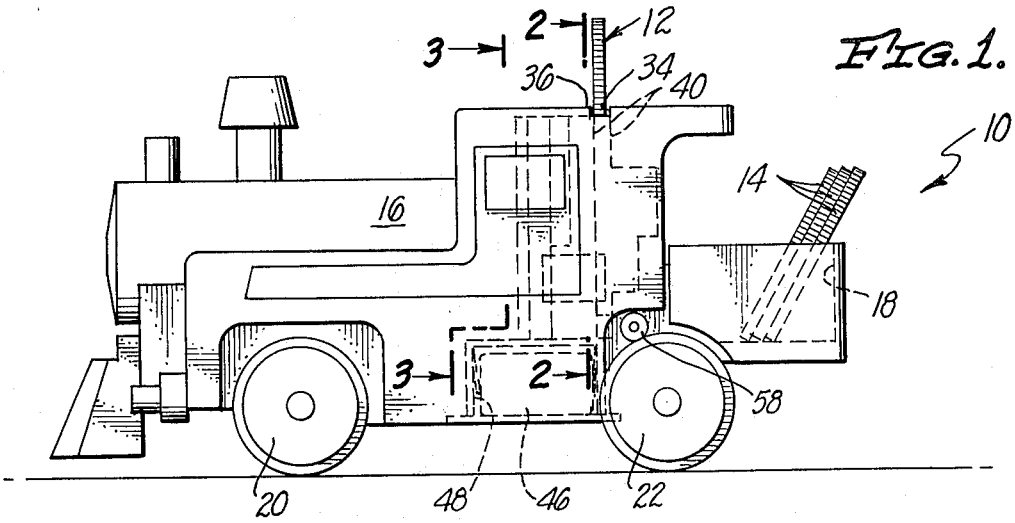
FIG. 1 is a side-elevational view of a presently preferred embodiment of a toy musical vehicle in accordance with the invention.

The concepts of the invention set forth and defined in the appended claims can be employed in a number of different manners in a number of different structures through the use or exercise of what is considered to be routine skill in either of the fields of musical organs or toys. The precise structure illustrated is shown solely to indicate one presently preferred manner of utilizing these concepts or principles. These are best further explained with reference to the accompanying drawings.

DETAILED DESCRITPION OF THE PREFERRED EMBODIMENT

The drawings show a toy vehicle 10 which is usable at one time with only a single disk 12 but which is adapted to carry a plurality of other similar disks 14. This vehicle 10 has a body 16 which is shaped so as to simulate a steam locomotive and which includes a rearwardly located receptacle 18 which supports various disks 14 when they are not in use. This body 16 is supported by front and rear wheels 20 and 22, respectively. These wheels 20 and 22 are connected to the body 16 in a conventional manner.

The disks 12 and 14 used with the vehicle 10 are all of the same type of construction. Each of these disks 12 and 14 has opposed, parallel surfaces 26 which are completely surrounded by an exteriorly projecting peripheral, concentric ring gear 28. These surfaces 26 carry intergrally formed cams or cam-like projections 30 which are arranged in a pattern about the axes of the disks 12 and 14 such that as a disk such as the disk 12 is rotated the cams 30 will operate within the vehicle 10 so as to produce selected sounds or notes preferably corresponding to a musical scale.

Figure 2:
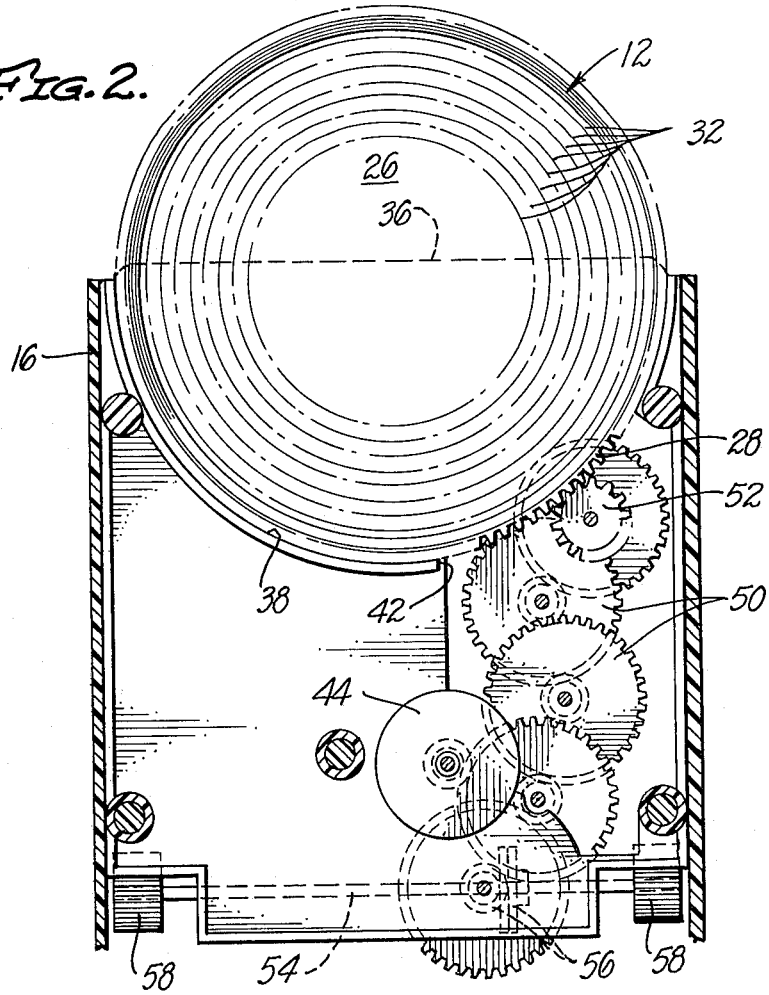
FIG. 2 is a partial cross-sectional view taken at line 2—2 of FIG. 1.
Figure 5:
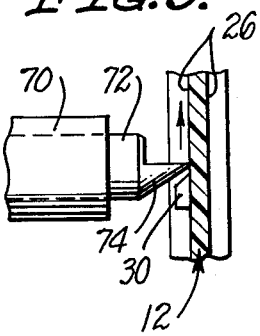
FIG. 5 is a partial cross-sectional view taken at line 5—5 of FIG. 4.
Figure 4:
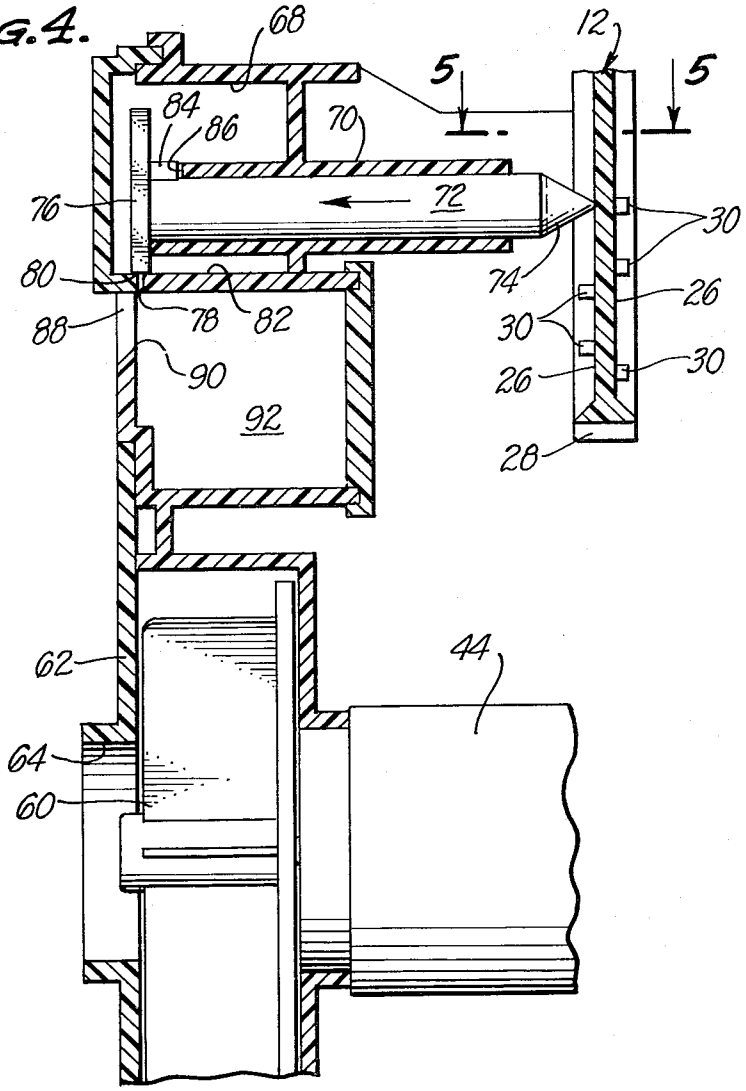
FIG. 4 is a partial cross-sectional view on an enlarged scale taken at line 4—4 of FIG. 3.
Figure 3:
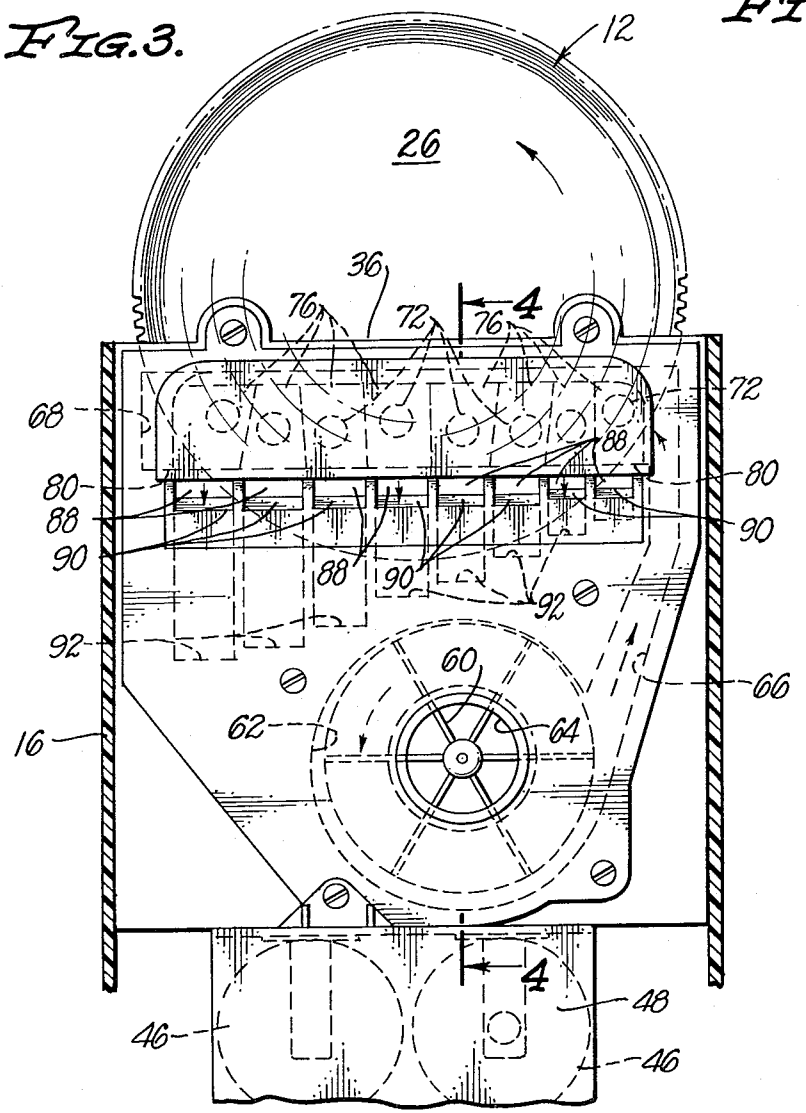
FIG. 3 is a partial cross-sectional view taken at line 3—3 of FIG. 1.

With this type of structure each cam 30 capable of producting a specific sound or note is located equidistant from the axis of a disk such as a disk 12 or a disk 14. Thus, all of the cams 30 corresponding to a particular sound or note are located in a circular path such as any of the paths 32 shown in dotted lines in FIG. 2 about the axis of the disk 12. These various circular paths 32 are, of course, concentric with one another about the axis of a disk 12 or 14.

During the use of the vehicle 10 the particular disk 12 used with this vehicle 10 is held by gravity within an upwardly projecting slot 34 in the body 16. This slot 34 has an open top 36 and a curved bottom wall 38 separating spaced side walls 40. A gap 42 is provided in the bottom wall 38 and one of the walls 40 for purposes as hereinafter indicated. These side walls 40 are parallel and are located sufficiently far apart so that a disk such as the disk 12 can be inserted between them in such a manner as to extend in a vertical plane. These side walls 40 are, however, closely enough spaced so that a disk 12 between them cannot cant out of such a plane to any significant or reasonably noticable extent.

The bottom wall 38 is preferably of a radius which closely approximates and is slightly larger than the radius of a disk 12 or 14. With this type of construction the bottom wall 38 will support a disk such as the disk 12 in such a manner that this disk 12 can be rotated about its axis without the position of this axis changing. Thus, in a sense the bottom wall 38 serves as a bearing or bearing means supporting the disk 12 held in the vehicle 10.

A disk 12 so held is not engaged by any portion of the slot 34 other than specifically indicated herein. Further, this slot 34 is formed so at no more than 180° of the periphery of the disk 12 is supported or engaged by the bottom wall 38. Less than this amount of the periphery of the disk 12 may be engaged by this bottom wall 38 provided that there is sufficient engagement for the disk 12 to be held vertically. In general it is believed that at least about one-third of the total area of a side of a disk 12 should be within the slot 34 so as to insure adequate support for the disk 12. This figure is not, however, considered to be a precise or critical figure.

The manner in which a disk 12 is utilized in the vehicle 10 is somewhat complex in that several mechanical actions are involved in such utilization. Within the body 12 there is mounted a conventional motor 44 which is adapted to be powered by batteries 46 located within a conventional battery cavity 48. The connections between the motor 44 and the battery 46 have been omitted from the drawing in the interest of simplicty since they are conventional. Further, normally a conventional or other switch will be located in the circuit between the motor 44 and the battery 46 for the purpose of controlling the operation of the vehicle 10. In the interest of simplicity such a switch has not been illustrated.

When the motor 44 is used it is employed to drive a gear train 50 of conventional design which is utilized for several purposes. A spur gear 52 forming a part of this gear train 50 extends into the gap 42 to a sufficient extent so as to rotate a disk 12 used with the vehicle 10 by engagement with the ring gear 28. This gear train 50 is also utilized to rotate a cross-shaft 54 through the use of reduction gears 56. This cross-shaft 54 carries drive wheels 58 which are adapted to rotate the rear wheels 22 through frictional contact.

The motor 44 also carries a conventional impeller 60. This impeller 60 is located within a pump housing 62 having an inlet 64 formed within the interior of the body 16. An outlet conduit 66 leading from the periphery of the housing 62 connects the interior of this housing 62 with an enlarged wind chest 68 formed within the body 16. This wind chest 68 serves as a plenum chamber and is adapted to hold a quantity of compressed air pumped to it through the rotation of the impeller 60.

A plurality of cylindrical bearings 70 are located so as to extend into the interior of the wind chest 68 from adjacent to one of the side walls 40. These bearings 70 hold push or actuator rods 72 in such a manner that substantially no air can leak out of the wind chest 68 between the bearings 70 and the rods 72 and in such a manner that these rods 72 can be linearly moved back and forth. Each of these rods 72 carries a cam follower 74 which is adapted to be engaged by any cam 30 corresponding to a particular sound or tone located upon a disk 12.

Such contact will occur as a disk 13 in the vehicle 10 is rotated and will serve to push a particular rod 72 engaged away from a disk 12. As this occurs a valve body 76 mounted upon such a rod 72 within the wind chest 68 will be linearly moved so as to uncover a slot 78 in the bottom of the wind chest 68. It will be realized that each of the rods 72 carries a valve body 76. These valve bodies 76 have flat bottoms 80 which ride against a flat bottom 82 of the wind chest 68 in such a manner that there is substantially no air leakage between the valve bodies 76 and the bottom 82 through the various slots 78. If desired small elongated keys 84 may be located on the rods 72 so as to fit within elongated slots 86 in the bearings 70 so as to prevent the individual push rods 72 from turning.

It is to be noted that the amount to which the push rods 72 can be moved toward the interior of the wind chest 68 through contact with the cams 30 on a disk 12 is limited to such an extent that the valve bodies 76 cannot be pushed flat against the interior of the wind chest 68. This makes it possible for the pressure of the air within the wind chest 68 to continuously bias the push rods 72 outwardly so that the followers 74 can be engaged by the cams 30 as the disk 12 is rotated. To facilitate assembly normally the various valve bodies 76 will be formed so as to have different configurations which fit closely adjacent to one another when all of the valve bodies 76 are extended with the rods 72 in a cam engaging position.

The air which escapes from the wind chest 68 when a particular valve body 76 is moved so as to uncover a slot 78 moves across a conventional mouth 88 toward a lip 90 so as to generate sound in a conventional manner. Preferably the body 16 includes individual sounding chambers 92 in association with each of the slots 78, mouth 88 and lips 90. These mouths 88 and lips 90 and their associated chambers 92 are tuned so as to obtain effective reinforcement of sounds or tones corresponding to the individual cams 30 on a disk 12. From this it will be apparent that the chambers 92 correspond to the sounding chambers or resonating pipes used with conventional wind organs.

Further, the individual mouths 88 and lips 90 associated with these chambers 92 are sound producing means for use in producing sound in response to a stream of compressed gas. This type of construction roughly corresponds to the type of structure utilized in a conventional labial pipe organ. If desired conventional reeds can be utilized instead of the mouths 88 and the lips 90 for producing sound in response to a stream of compressed gas.

It is believed that the operation of the vehicle 10 will be apparent from a detailed consideration of the preceding. As the motor 44 is operated this vehicle 10 will be propelled in a forward direction. Concurrently air will be blown into the wind chest 68 so as to bias the followers 74 where they can be engaged by cams 30. Such engagement will periodically occur as a consequence of the motor 44 rotating a disk 12 used within the vehicle 10. At any time such a disk 12 may be replaced by lifting it out of the slot 34 in its place. Similarly a disk 12 may be pulled out of the slot 34 and may be reinserted in a reverse position. Such changes of either the orientation of a particular disk 12 or of individual disks 12 and 14 enables different melodies or musical compositions to be played with a minimum of difficulty.

I claim:

1. A musical instrument having in combination a compressed gas source, a wind chest connected to said source, a plurality of sound producing means for use in producing sounds in response to a stream of compressed gas located adjacent to said wind chest, valve means for controlling the flow of gas from said wind chest to each of said sound producing means, and a rotary actuator for controlling the operation of said valve means, in which the improvement comprises:

said rotary actuator being located in a recess which is immobile with respect to the remainder of said instrument extending 180 degrees around the periphery of said actuator, said recess fitting with respect to said actuator in such a manner that said actuator is held by the confines of said recess so that it can be rotated and so that it cannot move in a axial direction as it is rotated, each of said valve means including a movable body capable of being moved in controlling the flow of gas from said wind chest, each of said bodies including a cam follower, said body being located during the operation of said instrument so that said cam followers extend into said recess, cam actuating means on said actuator for selectively moving said bodies so as to activate said valve means during rotation of said actuator, said actuator being located so that said cam actuating means will engage said cam followers during rotation of said actuator and rotary drive means located so as to extend into said recess for engaging the periphery of said actuator in order to continuously rotate said actuator during the operation of said instrument, said actuator being held within said recess by gravity so that there is engagement between the periphery of said actuator and said drive means.

2. A musical instrument as claimed in claim 1 wherein:

said actuator is a disk having sides, and wherein said recess is a slot, said disk fitting closely within said slot.

3. A musical instrument as claimed in claim 1 wherein:

each of said valve means includes a surface within said wind chest located so as to be acted upon by the compressed gas within said wind chest so as to be biased by said compressed gas so that said cam followers extend outwardly from said wind chest into positions in which they may be engaged by said cams during the rotation of said actuator.

4. A musical instrument as claimed in claim 1 wherein:

said rotary actuator includes a ring gear on the periphery thereof, and said drive means is a spur gear which extends into said recess and mates with said ring gear.

5. A musical instrument as claimed in claim 1 wherein:

said actuator is a disk having sides, and wherein said recess is a slot, said disk fitting closely within said slot, said rotary actuator includes a ring gear on the periphery thereof, and said drive means is a spur gear which extends into said recess and mates with said ring gear, said gas source comprises a blower and including motor means for concurrently operating said blower and said drive means.

each of said valve means includes a surface within said wind chest located so as to be acted upon by the compressed gas so that said cam followers extend outwardly from said wind chest into positions in which they may be engaged by said cams during the rotation of said actuator.

6. A musical instrument as claimed in claim 1 wherein:

said gas source comprises a blower and including motor means for concurrently operating said blower and said drive means.

7. A musical instrument having in combination a compressed gas source, a wind chest connected to said source, a plurality of sound producing means for use in producing sounds in response to a stream of compressed gas located adjacent to said wind chest, valve means for controlling the flow of gas from said wind chest to each of said sound producing means, and a rotary actuator for controlling the operation of said valve means, in which the improvement comprises:

said instrument forming a part of a movable toy vehicle having wheels, 'said gas source comprising a blower, said rotary actuator being located in a recess extending less than 180° around the periphery of said actuator, said recess fitting with respect to said actuator in such a manner that said actuator is held by the confines of said recess so that it can be rotated and so that it cannot move in an axial direction as it is rotated, actuating means on said actuator for selectively actuating said valve means during rotation of said actuator, said actuator being located so that said actuating means will operate said valve means during rotation of said actuator, drive means located so as to extend into said recess for engaging the periphery of said actuator in order to rotate said actuator during the operation of said instrument, said actuator being held within said recess by gravity so that there is engagement between the periphery of said actuator and said drive means, and said vehicle including a motor means for concurrently operating said blower and said drive means, said motor means also being operatively connected to the wheels of said vehicle so as to concurrently propel said vehicle while operating said blower and said drive means.

8. A musical instrument as claimed in claim 7 wherein:

each of said valve mans includes a surface within said wind chest located so as to be acted upon by the compressed gas within said wind chest so as to be biased by said compressed gas so that said cam followers extend outwardly from said wind chest into positions in which they may be engaged by said cams during the rotation of said actuator.

9. A musical instrument as claimed in claim 1 wherein:

said rotary actuator includes a ring gear on the periphery thereof, and said drive means is a spur gear which extends into said recess and mates with said ring gear, said actuator is a disk having sides, and wherein said recess is a slot, said disk fitting closely within said slot, there are sets of said actuating means located on each of the sides of said disk, only one of said sets being operative to operate said valve means at any one time.

* * * * *

UNITED STATES PATENT OFFICE
CERTIFICATE OF CORRECTION

PATENT NO. : 3,982,459
DATED : SEPTEMBER 28, 1976
INVENTOR(S) : KENZO AKIYAMA

It is certified that error appears in the above-identified patent and that said Letters Patent are hereby corrected as shown below:

Column 8, line 16, claim 8 should read as follows:

"8. A musical instrument as claimed in claim 7 wherein:

said rotary actuator includes a ring gear on the periphery thereof, and said drive means is a spur gear which extends into said recess and mates with said ring gear, said actuator is a disk having sides, and wherein said recess is a slot, said disk fitting closely within said slot."

Column 8, line 25, claim 9 should be dependent upon claim --7-- instead of claim 1.

Signed and Sealed this
Eighteenth Day of January 1977

[SEAL]

*Attest:*

RUTH C. MASON
*Attesting Officer*

C. MARSHALL DANN
*Commissioner of Patents and Trademarks*